US005609908A

United States Patent [19]

Voss

[11] Patent Number: 5,609,908

[45] Date of Patent: Mar. 11, 1997

[54] APPARATUS FOR COATING A PRESSING CHAMBER WITH A LUBRICANT

[76] Inventor: Gunter Voss, Ziegelstadel 10, 86911 Diessen/Ammersee, Germany

[21] Appl. No.: 122,486

[22] PCT Filed: Feb. 5, 1992

[86] PCT No.: PCT/DE92/00075

§ 371 Date: Dec. 5, 1994

§ 102(e) Date: Dec. 5, 1994

[87] PCT Pub. No.: WO92/13643

PCT Pub. Date: Aug. 20, 1992

[30] Foreign Application Priority Data

Feb. 5, 1991 [DE] Germany ..... 41 03 413.9

[51] Int. Cl.[6] ..... B05D 1/00

[52] U.S. Cl. ..... 427/214; 427/236; 118/313; 118/317

[58] Field of Search ..... 118/313, 317; 427/133, 2.14, 236; 425/107, 225; 264/338; 239/423, 424, 424.5, 434.5

[56] References Cited

U.S. PATENT DOCUMENTS

| | | | |
|---|---|---|---|
| 3,857,363 | 12/1974 | Ferlito | 118/313 |
| 4,043,295 | 8/1977 | Speck et al. | 118/317 |
| 4,374,871 | 2/1983 | Steinbis | 118/317 |
| 4,388,343 | 6/1983 | Voss et al. | 425/107 |
| 4,758,142 | 7/1988 | Voss et al. | 425/7 |

FOREIGN PATENT DOCUMENTS

| | | | |
|---|---|---|---|
| 0029809 | 6/1981 | European Pat. Off. | 118/313 |
| 0244204 | 11/1987 | European Pat. Off. . | |
| 0379912 | 1/1990 | European Pat. Off. . | |
| 0393396 | 10/1990 | European Pat. Off. . | |
| 2717438 | 10/1978 | Germany . | |
| 2808342 | 9/1979 | Germany . | |
| 3902293 | 8/1990 | Germany . | |
| 2154903 | 9/1985 | United Kingdom . | |

OTHER PUBLICATIONS

Pharm. Ind. 50, 7,839–845 (1988) Prebkammerbeschichtung, ein Beitrag zur Optimierug der Tablettenherstellung, Gruber et al.

*Primary Examiner*—Laura Edwards

*Attorney, Agent, or Firm*—Antonelli, Terry, Stout & Kraus, LLP

[57] ABSTRACT

Disclosed is an apparatus for coating a substrate with a fluid, having a nozzle system which is provided with at least one two-substance nozzle for the intermittent discharge of the fluid and the discharge of a gas. The two-substance nozzle, in order to attain, respectively obtain, a rotating gas flow, has an inside nozzle and a ring chamber which coaxially encompasses the inside nozzle, with at least one gas inlet nozzle which runs into the lateral surface of this ring chamber and the longitudinal axis of the gas inlet nozzles not intersecting the longitudinal axis of the inside nozzle, and that the ring chamber has an outlet opening which encompasses the outlet opening of the inside nozzle, with a device being provided with which the lubricant can be intermittently supplied to the inside nozzle and another device being provided with which the gas can be continuously supplied to the gas inlet nozzle.

21 Claims, 3 Drawing Sheets

APPARATUS FOR COATING A PRESSING CHAMBER WITH A LUBRICANT

BACKGROUND OF THE INVENTION

The present invention relates to an apparatus for coating a substrate with a fluid, which in particular may be a dispersion or a suspension of a coating substance in a vaporizable carrier fluid, by means of a system of nozzles provided with at least one two-substance nozzle for the intermittent discharge of the fluid and the discharge of a gas.

Apparatuses of this kind are utilized, by way of illustration in so-called ink-jet printers, in particular, in "large character printing".

Moreover, such apparatuses can be employed in micro-dosaging and, in particular, for adding an active substance to a carrier, by way of illustration a tablet.

Another important use of such apparatuses is coating a pressing chamber with a lubricant: by way of illustration in the manufacture of tablets in human and/or veterinary medicine, of catalysts and various foodstuffs it is necessary to coat the top die, respectively the male mould, and the bottom die, respectively the female mould, with a lubricant in order to facilitate the pressing process as well as the ejection of the tablet following termination thereof.

DE-OS 27 17 438 proposes spraying the lubricant onto the pressing tools. Further details concerning the process described therein can be found in the article "Preβkammerbeschichtung, ein Beltrag zur Optimierung der Tablettenherstellung" (Pressing Chamber Coating, an Aid in Optimizing Tablet Production), published in Pharm. Ind. 50, 7, 839-845 (1988) or DE 39 02 293 A1.

The first figure of this article depicts a pressing chamber coating apparatus on which the generic part of hereto is based. In this apparatus a system of nozzles is employed that is provided with a two-substance nozzle from which the lubricant mixed with air emerges intermittently. For this purpose, the lubrication medium and the air are fed in doses alternately one after the other into the antechamber of the nozzle.

Although this state-of-the-art apparatus permits drastic reduction of the lubricant needed per pressed piece to amounts ranging from 0.01 to 0.01 mg per pressed piece, an element of the present invention is understanding that this state-of-the-art apparatus, too, still has a substantial drawback which prevents further reduction of the amount of lubricant used per pressed piece:

In this apparatus, application of the lubricant occurs essentially on the bottom surface of the male mould and the female mould, respectively the bottom die; an element of the present invention is, however, comprehending that the lubricant is particularly needed along the peripheral edge of the tablet, i.e. of the female mould, and at those sites where only relatively little lubricant is applied in the state-of-the-art apparatus. Thus, in this apparatus more lubricant is applied to the bottom surfaces than is necessary if the amount of lubricant is optimumly dosed along the peripheral wall of the pressing chamber (i.e., female mould).

SUMMARY OF THE INVENTION

The object of the present invention is to improve an apparatus for coating a substrate with a lubricant by means of a system of nozzles having at least one two-substance nozzle for the intermittent discharge of fluid and the discharge of a gas in such a manner that it is possible, i.a., to obtain ring-shaped layers of coating on the substrate, so that, by way of illustration, with the use of the invented apparatus for coating a pressing chamber the lubricant is primarily applied to the peripheral wall of the pressing chamber (mainly female mould).

An inventive step is that the two-substance nozzle has an inside nozzle and a ring chamber which coaxially encompasses it. Into the lateral surface of this ring chamber leads at least one gas inlet nozzle whose longitudinal axis does not intersect the longitudinal axis of the inside nozzle. The ring chamber has an outlet opening which encompasses the outlet opening of the inside nozzle, with a device being provided with which fluid can be supplied intermittently to the inside nozzle as well as another device with which the gas can be continuously supplied to the gas inlet nozzle.

Due to this improvement the gas, which may in particular be air as well as an inert gas such as nitrogen or a noble gas, entering the ring chamber is turned into a "turbulent ring flow" which then "entrains" the convex meniscus formed at the outlet opening of the inside nozzle due to the dosage of the fluid. The fluid is transported to the substrate essentially in a rotating path which runs approximately on a conical surface.

Thus, by way of illustration, utilizing an invented apparatus for coating a pressing chamber with appropriate spacing of the two-substance nozzle from the bottom surface of the die results in a distinctly thicker coating of the peripheral surface due to the conical path than on the bottom surface and, in particular, in an excellent application of lubricant along the gap between the bottom die and the female mould.

In this application of an invented apparatus it is preferable if a system of nozzles is provided for the top and bottom tool respectively that is arranged in such a manner that the outlet openings lie opposite the respective bottom surface of the tool.

The "angle of the cone" depends on the distance (in the direction of the longitudinal axis) of the inside nozzle from the encompassing outlet opening as well as on the dimensions of the individual elements:

If the distance is increased, the diameter of the ring respectively of the dot diminishes. In reverse, the diameter of the ring increases if the distance is reduced. The distance can be adjusted by making the inside nozzle moveable relative to the ring chamber outlet in the direction of the longitudinal axis of the inside nozzle.

By way of illustration, an approximately 90° angle of the cone is yielded with usual lubricant viscosities the dimensions being those given in, the inside nozzle protrudes 0.1 mm over the ring opening.

By means of an appropriate selection of the distance between the front end of the inside nozzle and the outlet opening encompassing the inside nozzle as well as the design and, in particular, the inside diameter of the inside nozzle and dependent on the viscosity and the surface tension of the fluid, it can be attained that the convex fluid meniscus is essentially "entrained" by the vacuum generated by the rotating flow of gas, i.e., only a small venturi effect occurs at the inside nozzle. Thus an especially advantageous "ring-shaped layer of coating" of the fluid is yielded.

By means of an appropriate nozzle design, the "inside diameter of the ring" can be made so small that practise the result is a dot with an especially preferred almost rectangular distribution of the coat substance over the "surface of the dot".

Dimensions with which this can be achieved with conventional commercial inks or lubricants, respectively lubricant suspensions are given below, by way of example, Outside diameter of the inside nozzle approx. 0.7 mm, Inside diameter approx. 0.4–0.6 mm Diameter of the outlet opening encompassing the inside nozzle approx. 1 to 1.5 mm.

Other dimensions may, of course, also be selected: thus an especially small dot is yielded if the outside diameter of the inside nozzle is reduced (by way of illustration) to 0.2 mm and the inside diameter to 0.1 mm.

In particular, however, due to the invented improvement and especially due to the continuous flow enveloping the inside nozzle and the pressureless conveyance of the suspension to the filter, to the valve and to the nozzle, there is no ink or lubricant-suspension shearing, i.e. no fluid decomposition.

Thus not only all conventional inks and lubricants typical in tablet production, by way of illustration a stearic acid solution, can be used in the invented apparatus, but also inks, active substances or lubricants can be worked with which could not be employed in conventional apparatuses, by way of illustration an up to 50% suspension of magnesium stearate in alcohol Such high percentage suspensions cannot be dosed as precisely with conventional apparatuses as with the invented apparatus.

The suspensions that can be employed according to the present invention have the advantage that almost all the alcohol (ethanol) "evaporates" between the outlet opening and the tool surface, respectively the substrate so that the lubricant is applied "dry". Furthermore, the continuous flow of gas prevents the lubricant from "reentering" the nozzle as well as other causes of choking.

In any event, the invented apparatus permits dosing minute amounts of fluid in such a manner that it can be utilized in microdosage.

Furthermore, amounts of lubricant in the range of preferably 0.1–20 μg of lubricant per pressed piece can be worked with, i.e. the lubricant amounts required according to the present invention are smaller by an order of several magnitudes than the amounts needed for the state-of-the-art apparatuses.

The cross-section of gas inlet nozzle is contracted which, in particular, can attain at least a value of 2 in order to increase gas velocity.

Due to the pressure conditions when the gas is conveyed with an overpressure preferably of 100 to 500 mbar, a minimal stream of air is yielded that nonetheless results in a good layer of the fluid.

The improvement in which the axis of the gas inlet nozzle lies approximately in the tangent to the outer peripheral wall of the ring chamber, has the advantage that an especially favourable, turbulent flow is yielded.

For turbulent gas flow, it is particularly favourable to provide at least two gas inlet nozzles in the ring chamber.

If two gas inlet nozzles are employed, they lie diametrically opposite each other relative to the axis of the inside nozzle, whereas if three or more gas inlet nozzles are employed their longitudinal axes have the same angular spacing upon projection onto a plane running perpendicular to the longitudinal axis of the inside nozzle. Employing three or more, preferably four, gas inlet nozzles, further favors the "ring-shaped outflow" at the gas outlet.

The gas inlet nozzles may be spaced in the direction of the longitudinal axis of the Inside nozzle or lie in the same plane, which is preferably as near as possible to the ring-shaped outlet opening.

By means of the improvement in which the fluid is conveyed from the storage tank via a pump and a system of valves as well as appropriate connecting conduits back into the storage tank and the amount of fluid required for the coating is taken from the almost pressureless part of the cycle via a bypass conduit, the cross-section of which is preferably at least a factor 3 smaller than the cross-section of the supply line, a special pulsation-free and nonetheless intermittently operable variable conveyance of the small amounts of fluid required in the invented process is attained.

BRIEF DESCRIPTION OF THE DRAWING

The present invention is made more apparent in the following section without the intention of limiting the overall inventive concept using preferred embodiments with reference to the accompanying drawings, by way of example, to which moreover reference is to be made with regard to the disclosure of any details not explained in more detail in the text, wherein.

DESCRIPTION OF THE PREFERRED EMBODIMENTS

In the following section the present invention is described by way of example for the coating of a pressing chamber. However, it is self-evident that the system of nozzles designed according to the present invention may be utilized in the same manner for microdosaging or for a printer and, in particular, for a so-called large character printer.

Figure 1:
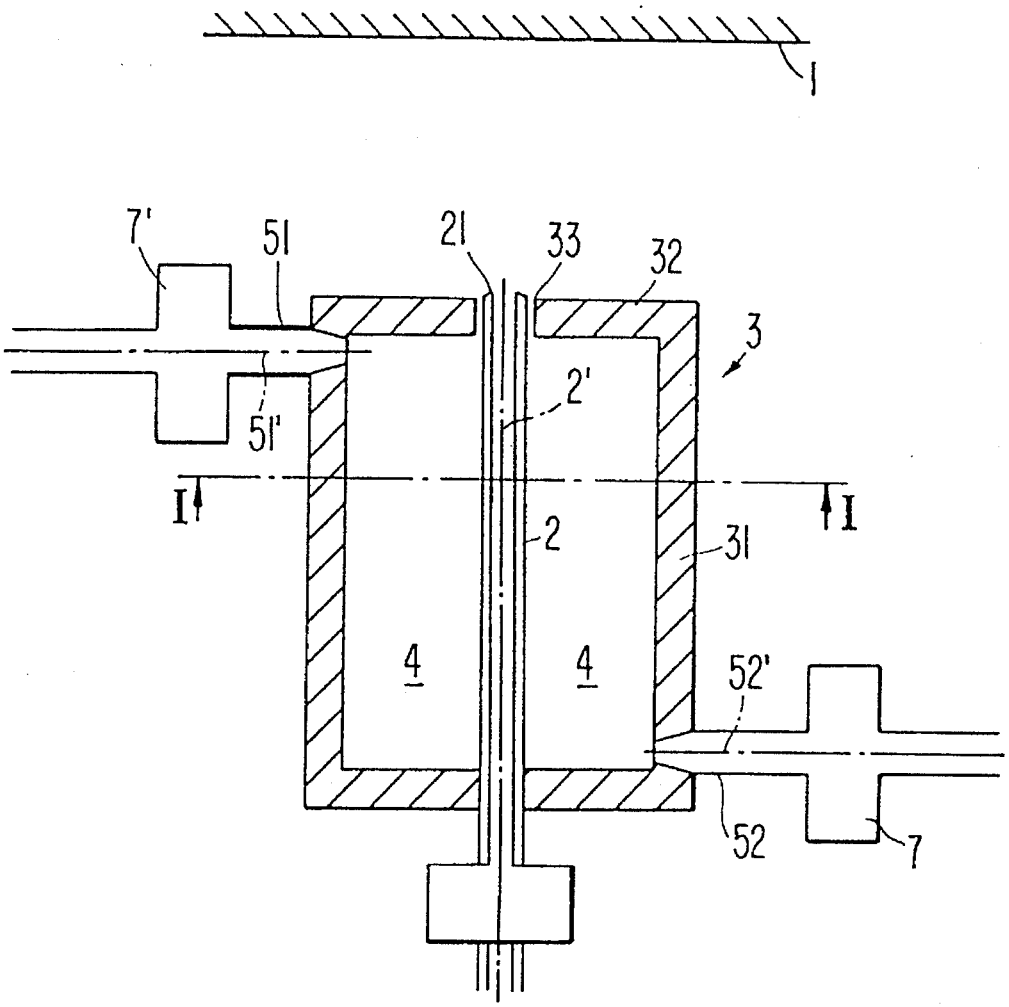
FIG. 1 shows longitudinal section of an invented apparatus.
Figure 2:
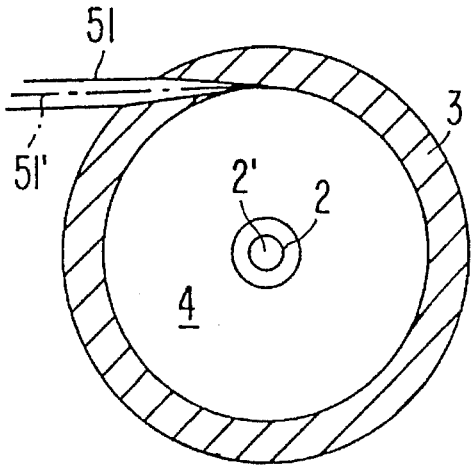
FIG. 2 shows cross-section at I—I in FIG. 1.

FIGS. 1 and 2 show invented apparatus for coating a pressing chamber 1 with a lubricant like those, in particular, employed for the manufacture of tablets is provided with an inside nozzle 2 having a longitudinal axis 2' to which the lubricant is supplied intermittently.

A body 3 in conjunction with the inside nozzle forms a ring chamber 4 which encompasses this inside nozzle. In the lateral surface 31 of the ring chamber are two gas inlet nozzles 51 and 52 having longitudinal axes 51' and 52' which are diametrically opposite each other relative to the axis of the inside nozzle and, in the case of the depicted preferred embodiment, are spaced in the direction of the axis of the inside nozzle 2. The axes of the gas inlet nozzles do not intersect the axis of the inside nozzle (2). In the case of the depicted preferred embodiment, the axes of the gas inlet nozzles are about in the tangent to the outer peripheral wall of the ring chamber.

Figure 3:
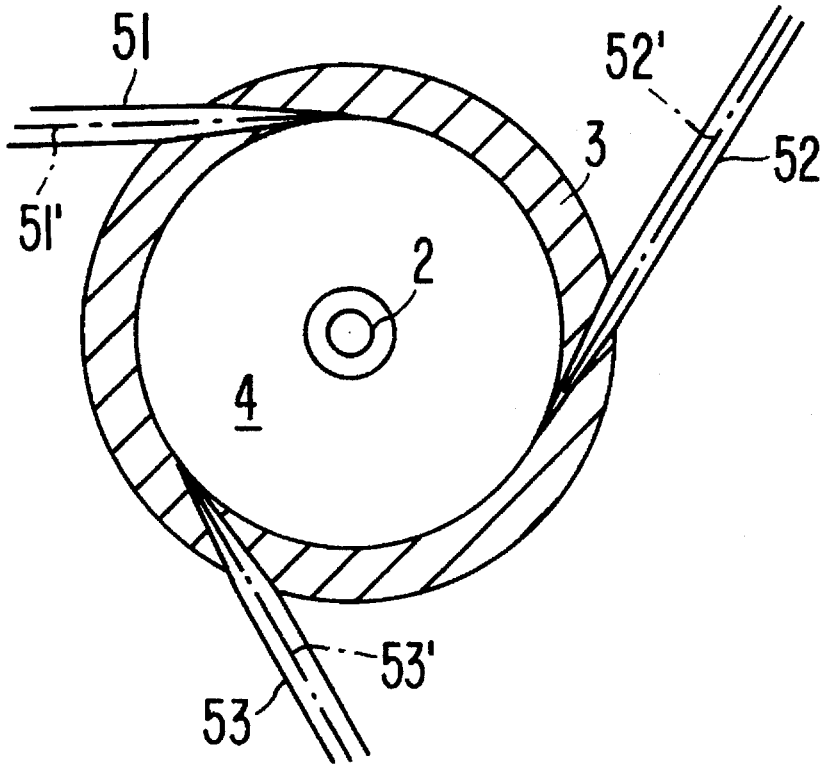
FIG. 3 shows a cross-section similar to that shown in FIG. 2 illustrating an alternative embodiment.

In an alternative embodiment shown in FIG. 3, three or more gas inlet nozzles 51, 52, 53 are provided having respective longitudinal axes 51', 52', 43' equi-angularly spaced upon projection onto a plane running perpendicular to the longitudinal axis 2' of the inside nozzle 2.

As shown in FIG. 1, gas, by way of illustration air, is continuously conveyed by devices 7', 7 through gas inlet nozzles 51 and 52, respectively. In order to increase gas velocity, the cross-section of gas inlet nozzles 51 and 52 is contracted by means of which the cross-section area is typically reduced at least by a factor 2.

In this way it is possible to convey small gas flows with little overpressure usually in the range of 100 to 500 mbar. Nonetheless good gas turbulence is yielded in the ring chamber 4, In the front face 32 of body 3 is a gas outlet opening 33 which encompasses the inside nozzle 2.

In the shown preferred embodiment, the individual elements have the following dimensions:

Outside diameter of the inside nozzle: approx. 0.7 mm,

Inside diameter of the inside nozzle: approx. 0.4 mm

Diameter of the outlet opening encompassing the inside nozzle: approx. 1 mm

Furthermore, the periphery 21 of the inside nozzle 2 protrudes approx. 0.1 mm beyond the ring opening 33, The periphery 21 of the inside nozzle is preferably conically bevelled et an angle of 30° to 45°.

Figure 4:
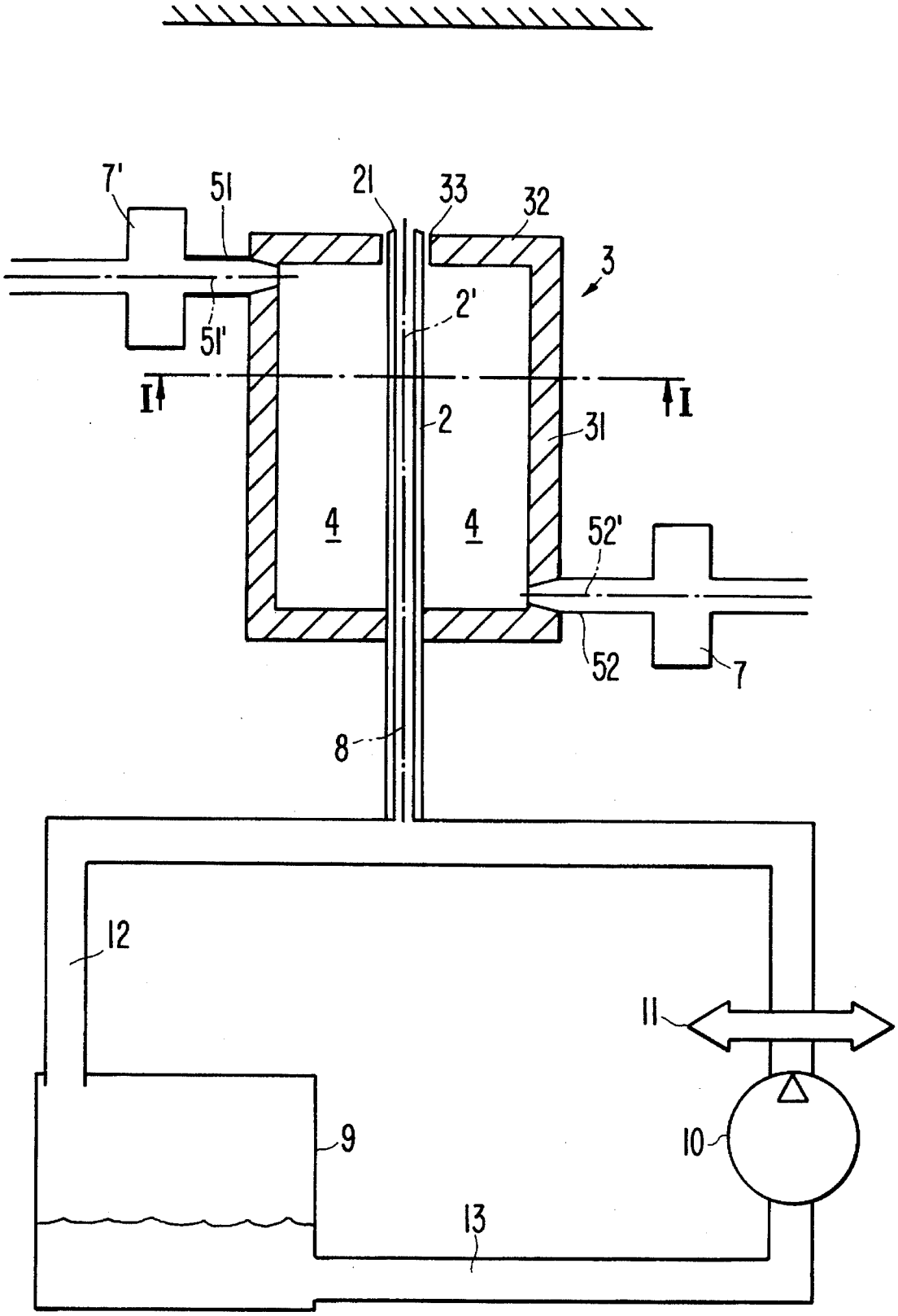
FIG. 4 shows a longitudinal section of the invented apparatus with an improved fluid conveying system.

The lubricant container may be a diffusion-resistant bag with an inlet and outlet and a visual control. The fluid is preferably added intermittently by a high-speed microvalve 6 to the rotating continuously close-sitting gas flow. The opening time of the microvalve 6 can be adjusted dependent on the applied pressure. The dosing and supply process lasts about 0.5 to 1 msec. The valve 6 operates with an almost pressureless fluid so that it can be triggered with a frequency of 100 to approximately 300 Hz or more. Nonetheless gas consumption only amounts to approximately 2 l/min. FIG. 4 shows the invented apparatus including a device for intermittently supplying fluid comprising a supply tank 9, a pump 10 for pumping fluid from the supply tank 9 and a valve system 11 as well as corresponding transporting conduit 13 for transporting fluid back into the supply tank 9, wherein an amount of fluid required for application is drawn from a pressureless part of the cycle via a bypass conduit 8, the cross-section of which is at least smaller by a factor 3 than the cross-section of the transporting conduit 12.

In any event, by means of the invented improvement the lubricant is transported on a rotating path that runs diagonally to the axis of the nozzle.

In the previous section the present invention is described using a preferred embodiment. There are, of course, many different modifications and alterations possible within the general inventive concept as indicated in the claims.

In any event, as the fluidized fluid is transported in a rotating manner, the formation of so-called satallites is largely prevented.

What is claimed is:

1. An apparatus for coating a substrate with a fluid, comprising:

a two-substance nozzle for the discharge of a fluid and a gas, the two-substance nozzle comprising an inside nozzle having a longitudinal axis and an outlet opening, and a ring chamber surrounding the inside nozzle and having an opening coaxially arranged about the inside nozzle;

at least one gas inlet nozzle connected to the ring chamber for conveying gas onto a lateral surface inside the ring chamber, wherein the at least one gas inlet nozzle has a longitudinal axis which does not intersect the longitudinal axis of the inside nozzle;

a device, in fluid communication with the inside nozzle, for intermittently supplying fluid to the inside nozzle to provide a convex fluid meniscus at the outlet opening of the inside nozzle; and a device, in fluid communication with the at least one gas inlet nozzle, for continuously supplying gas to the at least one gas inlet nozzle;

wherein a distance between the outlet of the inside nozzle and the outlet of the ring chamber is sufficient to attain entrainment of the convex fluid meniscus by the continuously supplied gas in a rotating path having a conical development.

2. An apparatus according to claim 1, wherein a cross-section of said at least one gas inlet nozzle is contracted in order to increase a velocity of the gas.

3. An apparatus according to claim 2, wherein a cross-section of the at least one gas inlet nozzle at an inlet thereof is at least twice that of an outlet thereof.

4. An apparatus according to claim 3, wherein the device for continuously supplying gas conveys the gas with an overpressure of 100 to 500 mbar compared to ambient pressure.

5. An apparatus according to claim 1, wherein the longitudinal axis of said at least one gas inlet nozzle is at a tangent to a outer peripheral wall of an inside of said ring chamber.

6. An apparatus according to claim 1, wherein two gas inlet nozzles are provided and have longitudinal axes diametrically opposite each other upon projection onto a plane running perpendicular to the longitudinal axis of said inside nozzle.

7. An apparatus according to claim 1, wherein three or more gas inlet nozzles are provided and have longitudinal axes equi-angularly spaced upon projection onto a plane running perpendicular to the longitudinal axis of said inside nozzle.

8. An apparatus according to claim 6 or 7, wherein the longitudinal axes of said gas inlet nozzles are spaced apart in a direction of said longitudinal axis of said inside nozzle.

9. An apparatus according to claim 6 or 7, wherein the longitudinal axes of said gas inlet nozzles lie in a plane which runs perpendicular to the longitudinal axis of said inside nozzle.

10. An apparatus according to claim 1, wherein said inside nozzle is moveable relative to the ring chamber outlet in the direction of the longitudinal axis of said inside nozzle.

11. An apparatus according to claim 1, wherein said inside nozzle is bevelled conically at an angle of approximately 30° to 45°.

12. An apparatus according to claim 1, wherein an outside diameter of said inside nozzle is approximately 0.7 mm, an inside diameter approximately 0.4 mm to approximately 0.6 mm and a diameter of said outlet opening which encompasses said inside nozzle is approximately 1 to approximately 1.5 mm.

13. An apparatus according to claim 1, wherein the gas is air.

14. An apparatus according to claim 13, wherein the device for intermittently supplying fluid transports 0.1–20 μg of fluid lubricant for an application of coating by adjusting an opening time of a valve in a lubricant supply line in fluid communication with the inside nozzle dependent on applied pressure.

15. An apparatus according to claim 1, wherein the device for intermittently supplying fluid includes a supply tank, a pump for pumping fluid from the supply tank and a valve system as well as a corresponding transporting conduit for transporting fluid back into said supply tank, wherein an amount of fluid required for application is drawn from a pressureless part of the cycle via a bypass conduit, the cross-section of which is at least smaller by a factor 3 than the cross-section of the transporting conduit.

16. An apparatus according to claim 15, wherein said pump works in suction operation following switch-off of transport operation and valves of fluid supply device being opened.

17. In an ink-jet printer, the improvement comprising an apparatus for applying ink to a substrate, comprising:

a two-substance nozzle for the discharge of an ink and a gas, the two-substance nozzle comprising an inside nozzle having a longitudinal axis and an outlet opening, and a ring chamber surrounding the inside nozzle and having an opening coaxially arranged about the inside nozzle;

at least one gas inlet nozzle connected to the ring chamber for conveying gas onto a lateral surface inside the ring chamber, wherein the at least one gas inlet nozzle has a longitudinal axis which does not intersect the longitudinal axis of the inside nozzle;

a device, in fluid communication with the inside nozzle, for intermittently supplying ink to the inside nozzle to provide a convex ink meniscus at the outlet opening of the inside nozzle; and a device, in fluid communication with the at least one gas inlet nozzle, for continuously supplying gas to the at least one gas inlet nozzle;

wherein a distance between the outlet of the inside nozzle and the outlet of the ring chamber is sufficient to attain entrainment of the convex ink meniscus by the continuously supplied gas in a rotating path having a conical development.

18. In a method for microdosaging, the improvement comprising putting a medicinal substance in a tablet using an apparatus comprising;

a two-substance nozzle for the discharge of a gas and a fluid comprising the medicine, the two-substance nozzle comprising an inside nozzle having a longitudinal axis and an outlet opening, and a ring chamber surrounding the inside nozzle and having an opening coaxially arranged about the inside nozzle.;

at least one gas inlet nozzle connected to the ring chamber for conveying gas onto a lateral surface inside the ring chamber, wherein the at least one gas inlet nozzle has a longitudinal axis which does not intersect the longitudinal axis of the inside nozzle;

a device, in fluid communication with the inside nozzle, for intermittently supplying fluid to the inside nozzle to provide a convex fluid meniscus at the outlet opening of the inside nozzle; and a device, in fluid communication with the at least one gas inlet nozzle, for continuously supplying gas to the at least one gas inlet nozzle;

wherein a distance between the outlet of the inside nozzle and the outlet of the ring chamber is sufficient to attain entrainment of the convex fluid meniscus by the continuously supplied gas in a rotating path having a conical development.

19. In a method for coating a pressing chamber with a lubricant, the improvement comprising delivering the lubricant to the pressing chamber using at least one apparatus comprising:

a two-substance nozzle for the discharge of a gas and a fluid comprising the lubricant, the two-substance nozzle comprising an inside nozzle having a longitudinal axis and an outlet opening, and a ring chamber surrounding the inside nozzle and having an opening coaxially arranged about the inside nozzle;

at least one gas inlet nozzle connected to the ring chamber for conveying gas onto a lateral surface inside the ring chamber, wherein the at least one gas inlet nozzle has a longitudinal axis which does not intersect the longitudinal axis of the inside nozzle;

a device, in fluid communication with the inside nozzle, for intermittently supplying fluid to the inside nozzle to provide a convex fluid meniscus at the outlet opening of the inside nozzle; and a device, in fluid communication with the at least one gas inlet nozzle, for continuously supplying gas to the at least one gas inlet nozzle;

wherein a distance between the outlet of the inside nozzle and the outlet of the ring chamber is sufficient to attain entrainment of the convex fluid meniscus by the continuously supplied gas in a rotating path having a conical development.

20. A method according to claim 19, wherein the fluid is an up to 50% suspension of magnesium stearate in alcohol.

21. A method according to claim 19 or 20, wherein the step of delivering the lubricant to the pressing chamber comprises providing first and second ones of said at least one apparatus opposite a top tool and a bottom tool respectively of said pressing chamber with the outlets of the inside nozzles of said first and second ones of said apparatus being arranged in such a manner that they are opposite respective bottom surfaces of said top and bottom tools.

* * * * *